US006499464B2

(12) United States Patent
Rueger

(10) Patent No.: US 6,499,464 B2
(45) Date of Patent: Dec. 31, 2002

(54) METHOD FOR DETERMINING THE CONTROL VOLTAGE FOR AN INJECTION VALVE HAVING A PIEZOELECTRIC ACTUATOR

(75) Inventor: Johannes-Joerg Rueger, Vaihingen/enz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/896,229

(22) Filed: Jun. 29, 2001

(65) Prior Publication Data

US 2002/0046734 A1 Apr. 25, 2002

(30) Foreign Application Priority Data

Jul. 1, 2000 (DE) ..... 100 32 022

(51) Int. Cl.[7] ..... F02M 37/04
(52) U.S. Cl. ..... 123/446; 123/498
(58) Field of Search ..... 123/446, 498; 310/317, 316

(56) References Cited

U.S. PATENT DOCUMENTS 5,130,598 A * 7/1992 Verheyen et al. ..... 310/317
6,021,760 A 2/2000 Boecking
6,318,342 B1 * 11/2001 Simon ..... 123/494
2001/0027780 A1 * 10/2001 Rueger et al. ..... 123/498

FOREIGN PATENT DOCUMENTS

DE 197 328 02 2/1999
DE 100 02 270 6/2001

* cited by examiner

*Primary Examiner*—Thomas N. Moulis
(74) *Attorney, Agent, or Firm*—Kenyon & Kenyon

(57) ABSTRACT

A method for determining the control voltage for a piezoelectric actuator of an injection valve in which at first the pressure in a hydraulic coupler is measured indirectly, before the next injection process. The pressure is measured since the piezoelectric actuator is mechanically coupled to the hydraulic coupler, so that the pressure induces a corresponding piezo voltage in the actuator. This induced voltage is used before the next injection process for correcting the control voltage for the actuator. Too low an induced voltage is valued as a fault for recognizing an intermittent injection operation. The injection valve may be used for a common rail system for fuel injection in a gasoline or diesel engine.

14 Claims, 3 Drawing Sheets

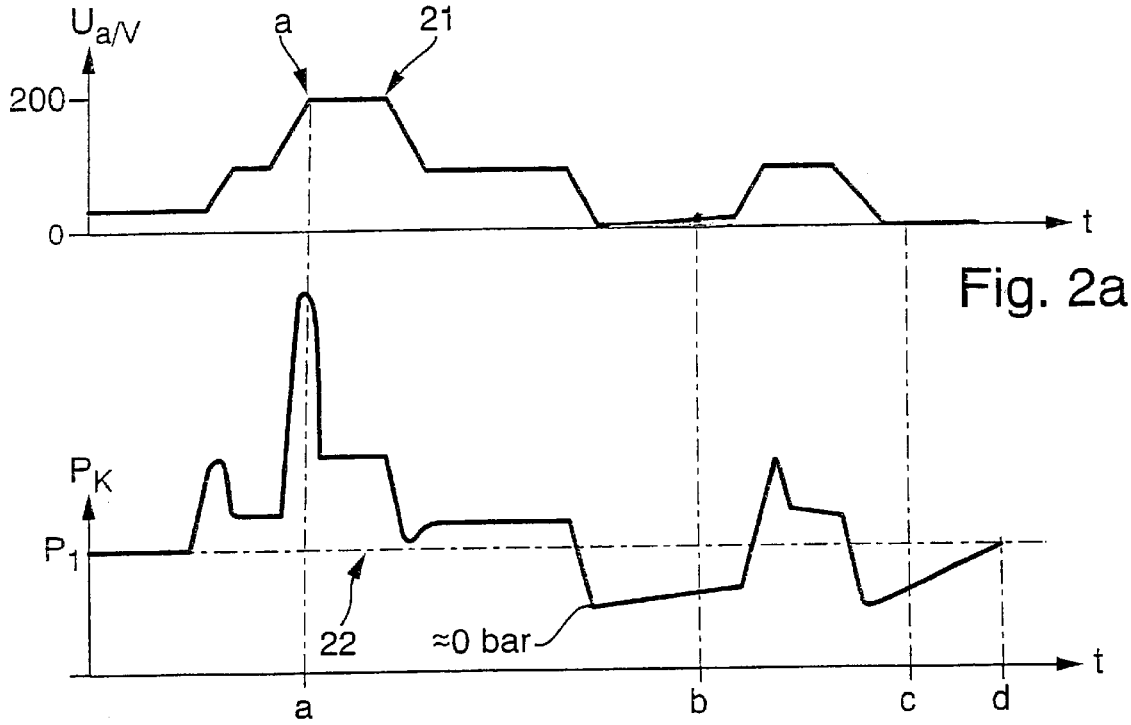
Fig. 2a
Fig. 2b
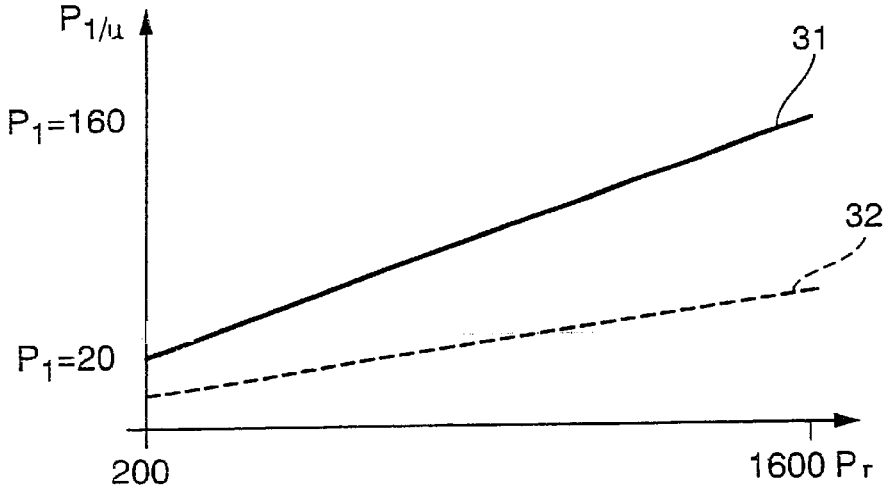
Fig. 3

METHOD FOR DETERMINING THE CONTROL VOLTAGE FOR AN INJECTION VALVE HAVING A PIEZOELECTRIC ACTUATOR

FIELD OF THE INVENTION

The present invention relates to a method for determining a control signal or drive voltage for a piezoelectric actuator of an injection valve.

BACKGROUND INFORMATION

An injection valve for injecting fuel into the combustion chamber of an internal combustion engine having a high pressure system (common rail system) is discussed in German Published Patent Application No. 197 328 02, which corresponds to U.S. Pat. No. 6,021,760. This injection valve has two valve seats against which a valve closing element is moved when activated by a piezo actuator. If the valve closing element starts out in a closing position at the first valve seat, it can be brought into an intermediate position between the valve seats and then into a second closing position at the second valve seat, with the aid of the piezo actuator. To accomplish this, the piezoelectric actuator is loaded to a control voltage which is a function of the pressure in the common rail system. On account of the voltage applied, the actuator stretches in the longitudinal direction and thereby moves the closing element in the direction of the second valve seat. To reverse the movement of the valve closing element in the direction of the first valve seat, the actuator is unloaded again.

By way of the sequence of movements of the valve closing element from one valve seat to the other, a short-term unloading of a valve control chamber, which is under high pressure, may be achieved, via whose pressure level the activating of a valve needle into an opening or closing position is performed. If the valve closing element is in an intermediate position between the two valve seats, fuel injection takes place. In this way, one can also produce a dual fuel injection, such as a pre-injection and a main injection.

The control of the valve member does not take place directly, but by a hydraulic transmission to a hydraulic coupler. When the piezoelectric actuator is loaded so strongly with voltage that the valve closing member moves from its valve seat, part of the fuel quantity present in the hydraulic chamber is squeezed out through its leakage passage. It is believed that this effect may be particularly large when the control valve is held at the second valve seat facing the high pressure area, since in this case the counteracting force may be particularly great because of the rail pressure. Recharging the low pressure area in the chamber of the hydraulic coupler takes place by a system pressure which, for example can be 15 bar, in practice. The recharging likewise is done via the leakage passage, but only at such time as the piezoelectric actuator is not activated.

In the case of the injection valve discussed above, however, the problem may arise, that the hydraulic coupler, as a rule, may not be completely recharged. The valve lift set at equal control voltages of the piezoelectric actuator can, therefore, be quite different, depending on the degree of recharging. The closer two injections follow one another, the less is the recharging of the coupler. It is also believed that it may be unfavorable that the amount of leakage becomes greater with a long trigger time of the actuator and with a longer loading period of the hydraulic coupler. In this case too, the recharging may not always be guaranteed, and so, a different valve lift is possible at an unchanged control voltage. Again, the different valve lift may have the subsequent disadvantage that the dosing of the injection quantity is imprecise, and, under certain circumstances, can have the effect that the desired injection of fuel does not take place if, because of the low recharging of the coupler, the valve is not positioned correctly, and, therefore, the nozzle needle is not opened.

SUMMARY OF THE INVENTION

An exemplary method according to the present invention, for determining the control voltage for a piezoelectric actuator of an injection valve, is believed to have the advantage that an optimal control voltage for the actuator may always be supplied, independently of the duration of the prior injection or its activation. It is also believed to be especially advantageous that, with the aid of the measured parameter, the injection valve may be positioned so that the requisite injection quantity is actually ejected, independently of the momentary filling level of the hydraulic coupler or the pressure prevailing in it. This may be particularly necessary with small dosings.

It is also believed to be especially advantageous that the pressure in the hydraulic coupler acts on the piezoelectric actuator and induces a voltage in it which is measurable at the output terminals. Because of this, advantageously, the pressure in the coupler, which acts on the actuator and induces a voltage in it, may be indirectly measured without a further sensor.

Furthermore, it is also believed to be advantageous that the pressure between two injections may be measured, for instance, shortly before the beginning of the next injection. That should at least better guarantee that the pressure present at the moment in the coupler is measured.

In another exemplary method, the algorithm may be stored in the form of a table, so that there is simple access to the corresponding correlation values between the pressure and the control voltage.

If, however, the induced voltage lies below a predefined threshold, one may assume that no injection or no correct one will take place, because the coupler was not sufficiently filled. It is believed that this effect can be advantageously used for recognizing intermittent operation or recognizing a fault in the charging of the coupler.

It is also believed to be advantageous to adjust the control voltage proportionally to the pressure of the coupler. This adjustment can be determined with a factor by which, for example, the control voltage is multiplied. In particular, in the measurement of the pressure of the coupler shortly before the subsequent injection, it is believed to be advantageously at least better guaranteed that the actual degree of recharging of the coupler is considered.

The determination and the production of the control voltage for the actuator by a software program represents a simple solution, which also makes simpler the application to different engine types, since no mechanical changes have to be made.

It is also believed that an advantage may be provided by using the exemplary method for fuel injection for an internal combustion engine, especially since the calculation of the control voltage can be set individually for each cylinder of the engine.

BRIEF DESCRIPTION OF THE DRAWINGS

FIG. 2*a* shows a diagram of the control voltage.

FIG. 2*b* shows a diagram of the pressure pattern.

FIG. 3 shows a diagram of the coupler pressure and the actuator voltage.

DETAILED DESCRIPTION

Figure 1:
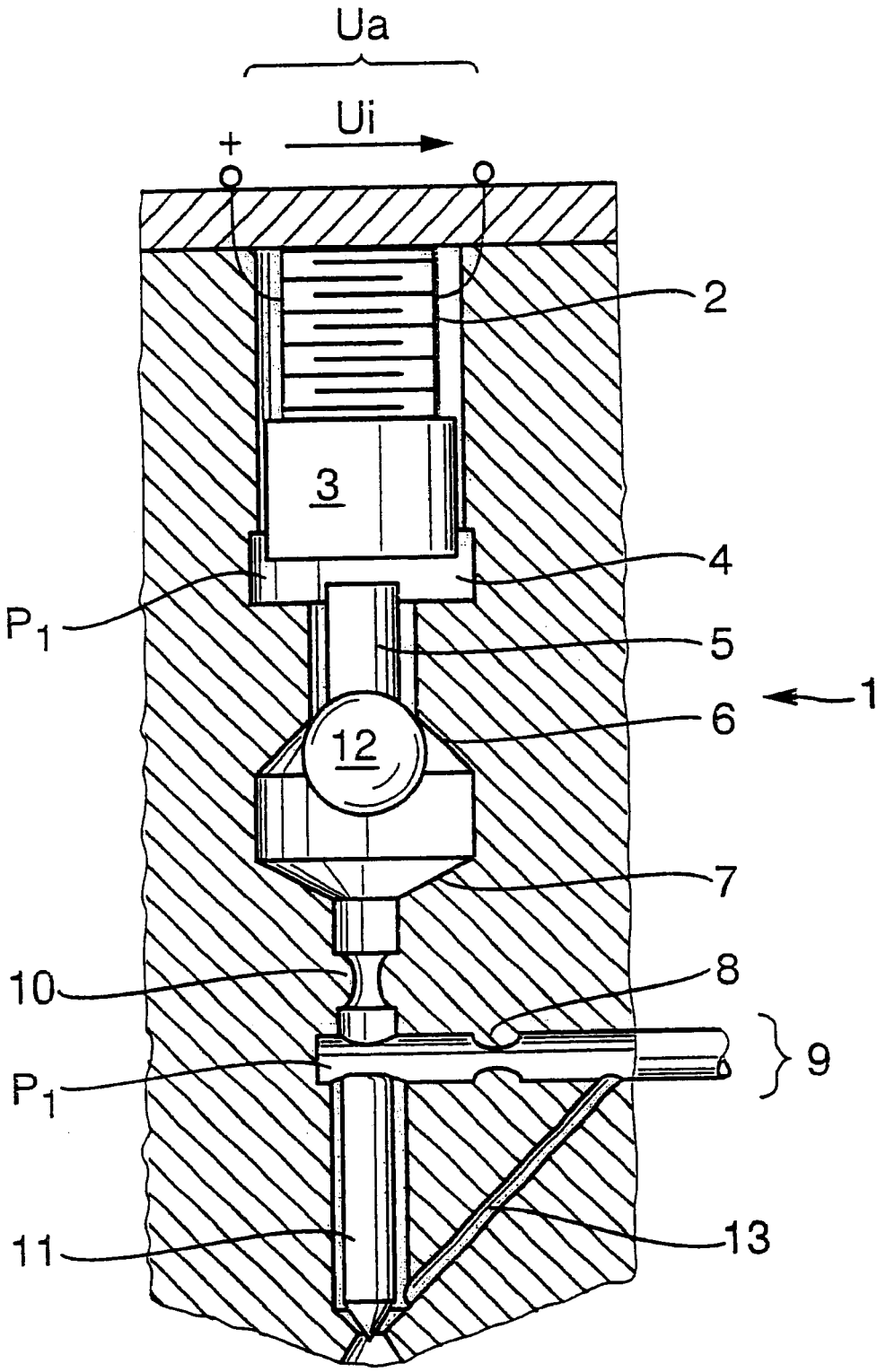
FIG. 1 shows a schematic construction of an injection valve.

FIG. 1 shows an injection valve 1 having a central bore. In the upper part there is a control piston 3 having a piezoelectric actuator 2 inserted in it, the control piston 3 being tightly connected to the actuator 2. The control piston 3 closes off towards its upper end a hydraulic coupler 4, while towards the lower end an opening having a connecting passage to a first seat 6 is provided, in which a piston 5 having a sealing element 12 is positioned. The sealing element 12 is a double-closing control valve. It seals the first seat 6 when actuator 2 is in the rest phase.

Upon the operation of actuator 2, that is, upon the application of a control voltage Ua to terminals +,–, actuator 2 activates the control piston 3 and presses piston 5 along with sealing element 12, via hydraulic coupler 4, in a direction towards a second seat 7. Underneath the second seat there is a nozzle needle 11, positioned in a corresponding passage which closes or opens the outlet in the high pressure passage (common rail pressure) 13, according to which control voltage is being applied.

The high pressure is supplied via an inlet 9 by the medium to be injected, for instance fuel for an internal combustion engine. The inflow quantity of the medium towards nozzle needle 11 and hydraulic coupler 4 is controlled via an inlet pressure-regulating valve 8 and an outlet pressure-regulating valve 10. During this process, hydraulic coupler 4 has the task, on the one hand, of increasing the lift of piston 5, and on the other hand, of decoupling the control valve from the static temperature expansion of actuator 2. The recharging of the coupler is not represented at this point.

In the following, the exemplary method of the injection valve is explained. At each activation of actuator 2, the control piston 3 is moved in the direction of coupler 4. During this time, piston 5 also moves, along with sealing element 12, in the direction of second seat 7. In the process, a part of the medium that is in the hydraulic coupler 4, for instance the fuel, is squeezed out via a leakage passage. Between two injections, therefore, hydraulic coupler 4 has to be recharged, to maintain its functional reliability.

A "high" pressure prevails via inlet passage 9, which may amount to between 200 and 1600 bar in the common rail system. This pressure acts against nozzle needle 11 and holds it closed, so that no fuel can emerge. Now, when, in consequence of the control voltage Ua, actuator 2 is activated and thereby moves sealing element 12 in the direction of the second seat, the pressure in the high pressure area is reduced and nozzle needle 11 frees the injection channel.

This performance characteristic of the injection valve 1 will again be explained with the diagrams in FIGS. 2*a* and *b*. In FIG. 2*a*, on the y axis the control voltage is plotted against the time axis t. Below that, in FIG. 2*b*, the appertaining coupler pressure $P_1$ is plotted, as measured in hydraulic coupler 4. Without activation, a stationary pressure $P_1$, sets in within the coupler, which is, for instance, 1/10 of pressure $P_r$ in the high pressure part. After an unloading of the actuator 2, the coupler pressure is approximately 0, and is raised again by the recharging.

Before, however, the new loading process the stationary recharging pressure $P_1$ is not reached as can be seen in position t=b. Only at time c does the pressure build-up due to recharging of coupler 4 take place, until coupler pressure $P_1$, is reached (d). The pressure sequence is controlled by control voltage Ua. In position a, the highest voltage, such as 200 V, and the highest pressure are reached. Then the pressure takes a course corresponding to the sequence of the voltage values, that is, depending on which position the sealing element 12 takes between first seat 6 and second seat 7. Since it may be desirable if the original coupler pressure P111 were reached as early as time b, if this is not the case, the control voltage has to be corrected.

According to the exemplary embodiment and/or exemplary method of the present invention, the pressure pattern in the hydraulic coupler 4 may be measured using the voltage (piezo voltage) $U_i$ induced in actuator 2. Because of the "high" pressure, especially in common rail systems, and because of the transformation ratio of the coupler of, for example, 1:10, a recharging pressure of up to 160 bar is derived.

Figure 5:
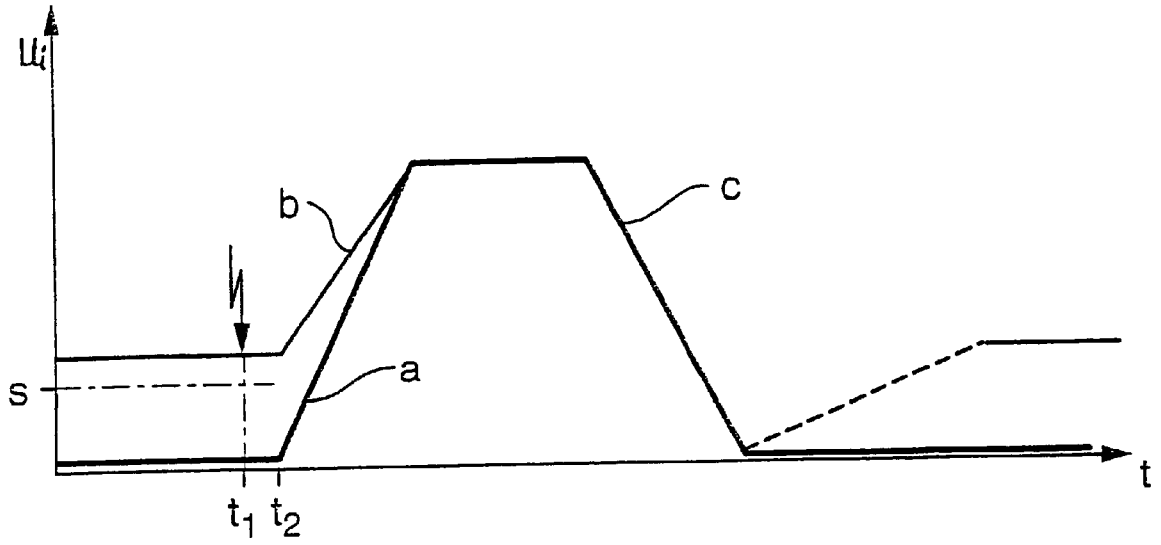
FIG. 5 shows a voltage/time diagram.

This "high" recharging pressure has the result that, with an actuator that is unloaded, that is, sealing element 12 lies up against first seat 6 of the double closing injection valve 1, a high pressure develops in coupler 4 which generates a corresponding piezo voltage Ui in actuator 2. Now, if coupler 4 is not filled, or not sufficiently so, a lower pressure follows in coupler 4, and with that, a lower voltage Uiii. FIG. 5 shows corresponding curves for voltage $U_i$.

Curve a shows the sequence during an empty coupler 4, and curve b shows the sequence during a filled coupler 4. If the voltage $U_i$ is measured at time t1, that is, immediately before the activation at t2, corresponding voltage patterns are obtained, depending on the degree of recharging of coupler 4.

By predefining a threshold value S, one can determine at time t1 whether coupler 4 is sufficiently filled or not. This is a good fault indicator for recognizing intermittent operation. This is because an insufficiently filled coupler 4 can have the effect of incomplete or missing fuel injections. In this case, under certain circumstances, even by raising the actuator voltage, the control valve can no longer be correctly activated, since the requisite pressure in the coupler cannot be applied. When the threshold is undershot, this fault can be output optically or acoustically and/or stored in an appropriate fault memory, so that the fault can even be read out later, for instance, in a repair shop.

A connection between the coupler pressure P1 and the induced actuator voltage $U_i$ is shown in FIG. 3. Here it is recognizable that the actuator voltage $U_i$ is proportional to the coupler pressure P1. Line 31 here shows the coupler pressure and line 32 shows the induced actuator voltage $U_i$. From these graphs it can be seen that, for instance, an algorithm may be implemented using a "simple" proportionality factor, which can be used for correcting the actuator voltage $U_i$ as a function of coupler pressure P1.

In another exemplary embodiment and/or exemplary method of the present invention, a table of values may be set up for the connection between pressure and the induced voltage, and for storing this in an appropriate memory. These values can be used for correcting the control voltage Ua by means of an appropriate program. The appropriate program may be a component of a system for engine control, especially for direct injection in a gasoline or diesel engine.

Figure 4:
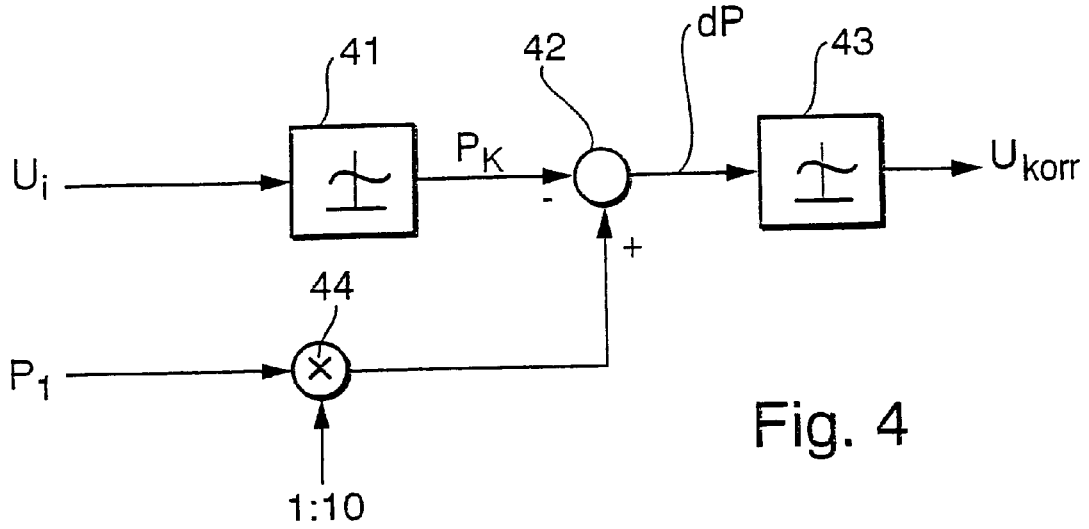
FIG. 4 shows a structural diagram.

FIG. 4 shows a structural diagram from which the software program for correcting the control voltage can be derived. This structural diagram is valid, for example, for a cylinder of the internal combustion engine, and can optionally be changed for a further cylinder. The voltage $U_i$ induced in actuator 2, which is a measure of the pressure in coupler 4 is worked up as a signal in position 41 and passed to subtracter circuit 42 as a pressure value P1. The value of pressure P1, which would occur in a steady state in coupler 44, is also conducted to subtracter circuit 42. As a result, a pressure difference dP is available at the output of subtracter circuit 42.

The pressure difference is further conducted to a characteristic curve 43, which creates from it a correction voltage $U_{korr.}$ This correction voltage is added to the control voltage Ua. For the purpose of recognizing intermittent operation, this voltage $U_{korr}$ is compared, for example, in a comparator, not shown, with a predefined threshold value S, and, if necessary, an appropriate error message is output and/or stored. Thereby, the fault is even available as proof at a later time.

Another exemplary embodiment and/or exemplary method of the present invention provides for using the induced voltage Ui or the coupler pressure Pk derived from it for fault recognition.

What is claimed is:

1. A method for determining a control voltage for a piezoelectric actuator of an injection valve, the injection valve being usable for injecting a quantity of liquid under a high pressure into a hollow space, the piezoelectric actuator being connected in a bore of the injection valve to an adjoining hydraulic coupler via a control piston functioning as a hydraulic transmission, a high pressure being exertable on the control piston having a sealing element for moving the sealing element into positions between a first seat and a second seat, the hydraulic coupler being rechargeable via an appropriate passage after an injection process, the method comprising:

measuring a parameter corresponding to a pressure in the hydraulic coupler after an injection process; and determining a value of the control voltage of the piezoelectric actuator by using the parameter and a predefined algorithm.

2. The method of claim 1, wherein the measuring includes measuring a voltage induced in the hydraulic coupler within the piezoelectric actuator conditioned upon the pressure in the hydraulic coupler as a parameter at terminals of the piezoelectric actuator.

3. The method of claim 2, wherein the measuring includes measuring the voltage between two injections.

4. The method of claim 1, wherein the control voltage is adjusted to the pressure actually prevailing in the hydraulic coupler.

5. The method of claim 1, wherein the predefined algorithm uses a table in which correlation values between the pressure of at least one of an induced pressure and the control voltage are stored.

6. The method of claim 1, further comprising outputting a fault message upon undershooting a predefined threshold value for at least one of an induced voltage and a calculated hydraulic coupler pressure.

7. The method of claim 6, wherein the outputting includes at least one of outputting the fault message optically, outputting the fault message acoustically and storing the fault message in a fault memory.

8. The method of claim 1, further comprising adjusting proportionally the control voltage to the pressure in the hydraulic coupler.

9. The method of claim 1, wherein the measuring includes measuring directly the actuator voltage before at least one of a subsequent activation and at a point in time at which a rail pressure in a high pressure passage is measured.

10. The method of claim 1, wherein the control voltage is determined using a software program.

11. The method of claim 10, wherein the software program is a component part of a computer system for providing at least one of an engine control and a control of a common rail system.

12. The method of claim 1, wherein the liquid is a fuel and the fuel is directly injected in one of a gasoline engine and a diesel engine.

13. An apparatus for determining a control voltage for a piezoelectric actuator of an injection valve, the injection valve being usable for injecting a quantity of liquid under a high pressure into a hollow space, the piezoelectric actuator being connected in a bore of the injection valve to an adjoining hydraulic coupler via a control piston functioning as a hydraulic transmission, a high pressure being exertable on the control piston having a sealing element for moving the sealing element into positions between a first seat and a second seat, the hydraulic coupler being rechargeable via an appropriate passage after an injection process, the apparatus comprising:

a measuring arrangement for measuring a parameter corresponding to a pressure in the hydraulic coupler after an injection process; and a determining arrangement for determining a value of the control voltage of the piezoelectric actuator by using the parameter and a predefined algorithm.

14. An apparatus for determining a control voltage for a piezoelectric actuator of an injection valve, the injection valve being usable for injecting a quantity of liquid under a high pressure into a hollow space, the piezoelectric actuator being connected in a bore of the injection valve to an adjoining hydraulic coupler via a control piston functioning as a hydraulic transmission, a high pressure being exertable on the control piston having a sealing element for moving the sealing element into positions between a first seat and a second seat, the hydraulic coupler being rechargeable via an appropriate passage after an injection process, the apparatus comprising:

means for measuring a parameter corresponding to a pressure in the hydraulic coupler after an injection process; and means for determining a value of the control voltage of the piezoelectric actuator by using the parameter and a predefined algorithm.

* * * * *